US008528760B2

(12) United States Patent
Lane et al.

(10) Patent No.: US 8,528,760 B2
(45) Date of Patent: Sep. 10, 2013

(54) LIGHTWEIGHT CONTAINER HAVING MID-BODY GRIP

(75) Inventors: Michael T. Lane, Brooklyn, MI (US); Ivan Harris, Ypsilanti, MI (US)

(73) Assignee: Amcor Limited, Hawthorn (AU)

( * ) Notice: Subject to any disclaimer, the term of this patent is extended or adjusted under 35 U.S.C. 154(b) by 1056 days.

(21) Appl. No.: 12/215,604

(22) Filed: Jun. 26, 2008

(65) Prior Publication Data

US 2009/0321386 A1 Dec. 31, 2009

(51) Int. Cl.
*B65D 1/02* (2006.01)

(52) U.S. Cl.
USPC ..... 215/381; 215/384; 220/675

(58) Field of Classification Search
USPC ..... 215/381, 384, 383, 382; 220/675, 220/673, 672, 671, 670
See application file for complete search history.

(56) References Cited

U.S. PATENT DOCUMENTS

| | | | | |
|---|---|---|---|---|
| 3,325,031 | A * | 6/1967 | Singier | 215/247 |
| D525,528 | S * | 7/2006 | Lane et al. | D9/516 |
| 7,455,189 | B2 * | 11/2008 | Lane et al. | 215/381 |
| 7,857,157 | B2 * | 12/2010 | Lane et al. | 215/383 |
| 2007/0039918 | A1 * | 2/2007 | Lane et al. | 215/381 |
| 2007/0045222 | A1 * | 3/2007 | Denner et al. | 215/382 |
| 2007/0170144 | A1 * | 7/2007 | Lane et al. | 215/383 |

* cited by examiner

*Primary Examiner* — Stephen Castellano
(74) *Attorney, Agent, or Firm* — Harness, Dickey & Pierce, P.L.C.

(57) ABSTRACT

The present disclosure provides a one-piece plastic container having a body defining a generally rectangular horizontal cross-section, and including a first pair of opposing sidewalls and a second pair of opposing sidewalls. The body has an upper portion, a shoulder region, a sidewall portion and a base. The shoulder region is integrally formed with and extends from the upper portion to the sidewall portion. The base closes off an end of the container. The shoulder region defines a pair of grip portions defined in part by a respective pair of pillars. Each pillar defines oppositely facing walls that are offset inboard relative to the respective second pair of opposing sidewalls.

20 Claims, 7 Drawing Sheets

34
20
10
D
18
35
E
29
22
23
4
4
54
42
54
F
50
50
5
5
25
52
52
30B
40
30A
A
38
36
G
14

26
H
28
C

LIGHTWEIGHT CONTAINER HAVING MID-BODY GRIP

TECHNICAL FIELD

This disclosure generally relates to plastic containers for retaining a commodity, such as a solid or liquid commodity. More specifically, this disclosure relates to a one-piece blown container having mid-body grip.

BACKGROUND

As a result of environmental and other concerns, plastic containers, more specifically polyester and even more specifically polyethylene terephthalate (PET) containers, are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where $\rho$ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25%-35%.

In some instances, it may be desirable to provide a user a grasping area on the container at which a user may engage and firmly hold the container. In one example, a container may define a handle near an upper shoulder of the container whereby a user can pass fingers or a thumb through an adjacent passage formed through the container to grasp the container. Such a configuration may be provided on a milk container for example. In other examples, it may be desirable to define a gripping portion integral with the body of the container. Furthermore, it is desirable to provide a gripping portion that contributes to the overall structural integrity of the container.

SUMMARY

Accordingly, the present disclosure provides a one-piece plastic container having a body defining a generally rectangular horizontal cross-section and including a first pair of opposing sidewalls and a second pair of opposing sidewalls. The body has an upper portion, a shoulder region, a sidewall portion and a base. The shoulder region is integrally formed with and extends from the upper portion to the sidewall portion. The base closes off an end of the container. The shoulder region defines a pair of grip portions defined in part by a respective pair of pillars. Each pillar defines oppositely facing walls that are offset inboard relative to the respective second pair of opposing sidewalls.

According to additional features, each grip portion is further defined by a pair of arched inset walls that transition from the second pair of opposing sidewalls, respectively to the pillars. In one example, each oppositely facing wall defines a substantially 90° angle relative to an adjacent arched inset wall at a horizontal cross-section taken through the shoulder region. Each pillar can define at least one horizontal rib and land formed thereon. According to still other features, a first and a second arched rib are defined on each of the second pair of opposing sidewalls. The first and second arched ribs cooperate to form a substantially oval geometry. The base may define an octagonal shape having a generally octagonal footprint. The shoulder portion defines a shoulder face. The pair of pillars define substantially about 20%-40% of the shoulder face. The shoulder portion can define a grip panel area at the second pair of opposing sidewalls.

Additional benefits and advantages of the present disclosure will become apparent to those skilled in the art to which the present disclosure relates from the subsequent description and the appended claims, taken in conjunction with the accompanying drawings.

DETAILED DESCRIPTION

The following description is merely exemplary in nature, and is in no way intended to limit the disclosure or its application or uses.

Figure 1:
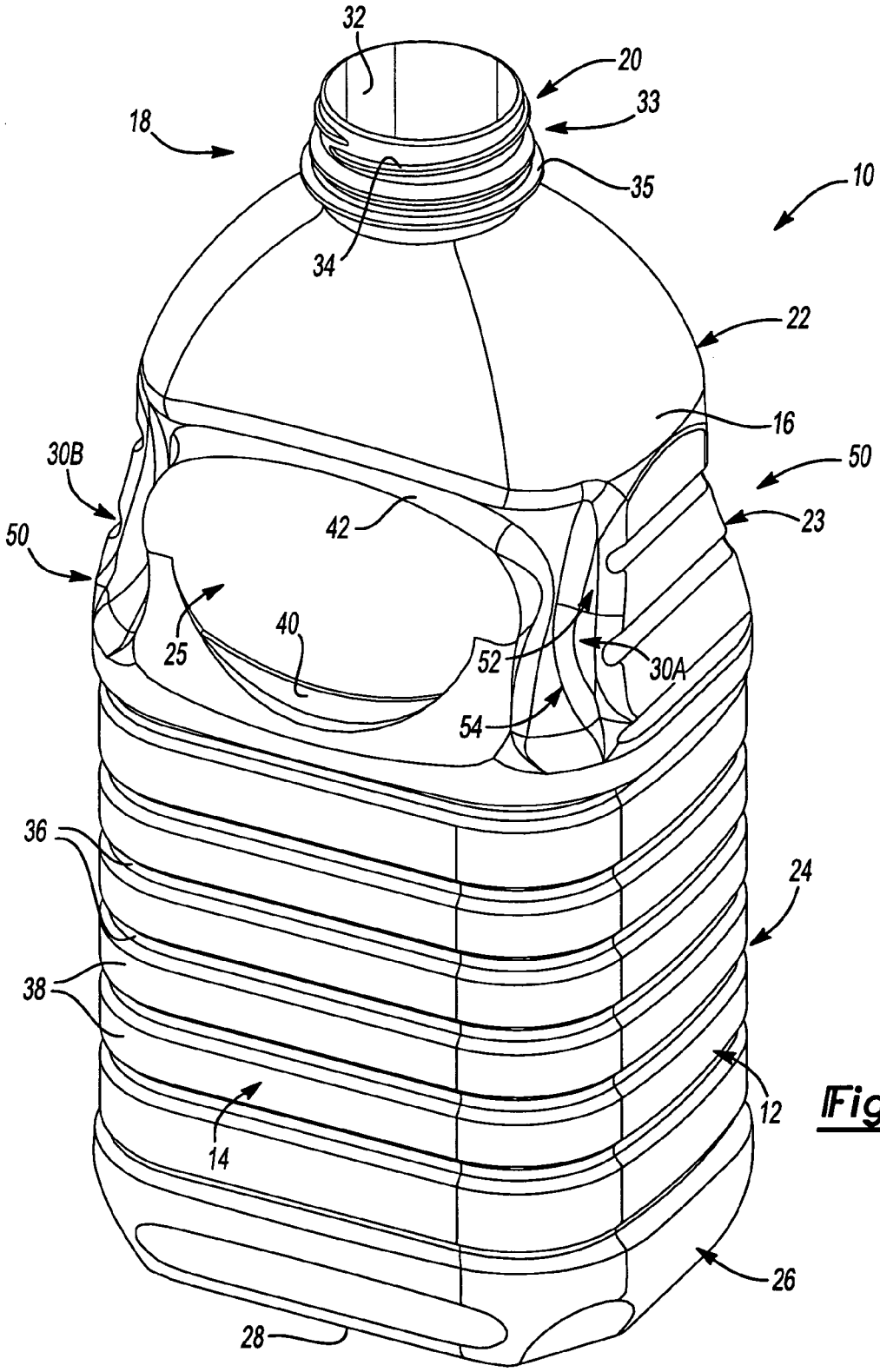
FIG. 1 is a front perspective view of a one-piece plastic container constructed in accordance with the teachings of the present disclosure.
Figure 2:
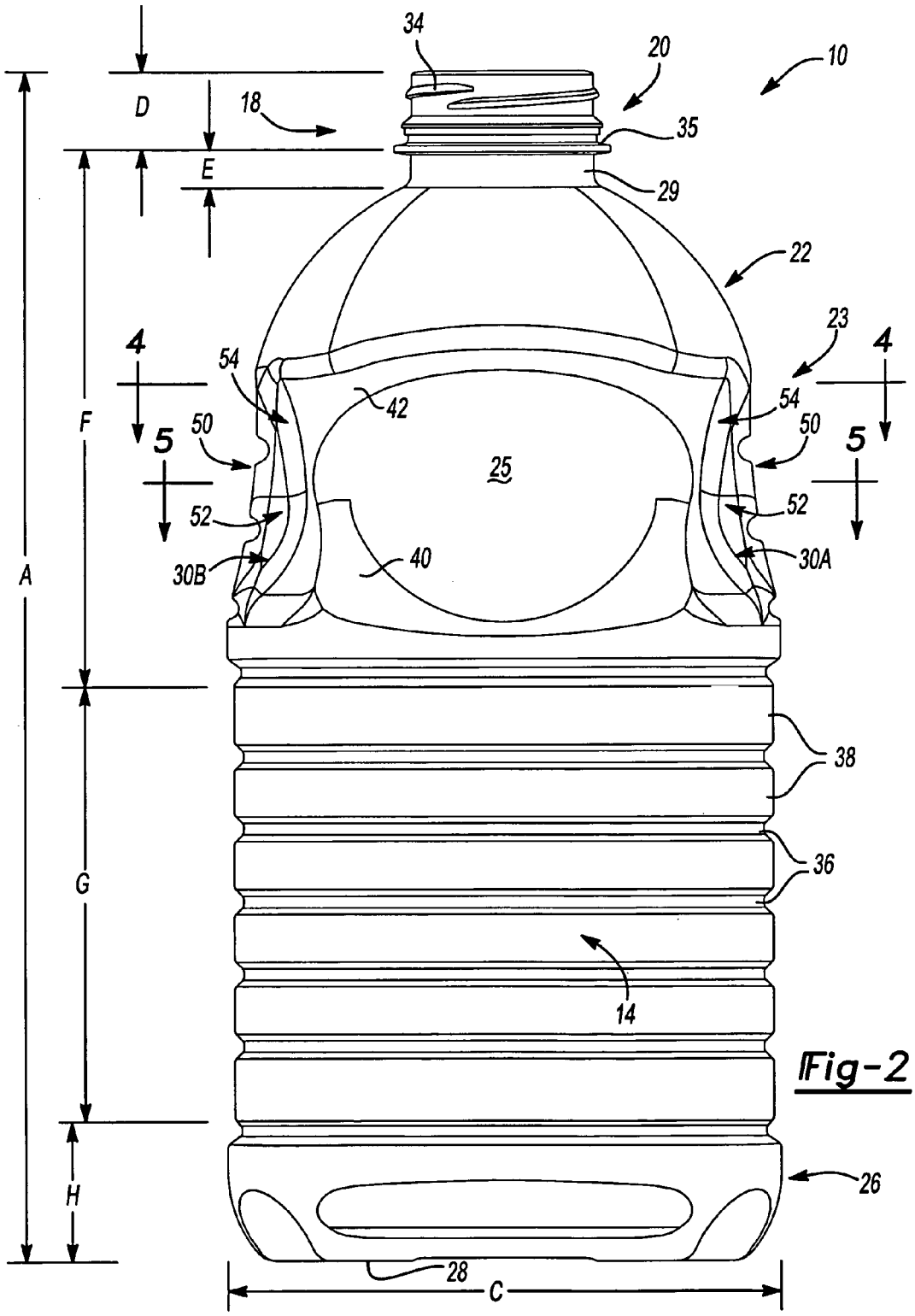
FIG. 2 is a front elevational view of the container of FIG. 1.
Figure 3:
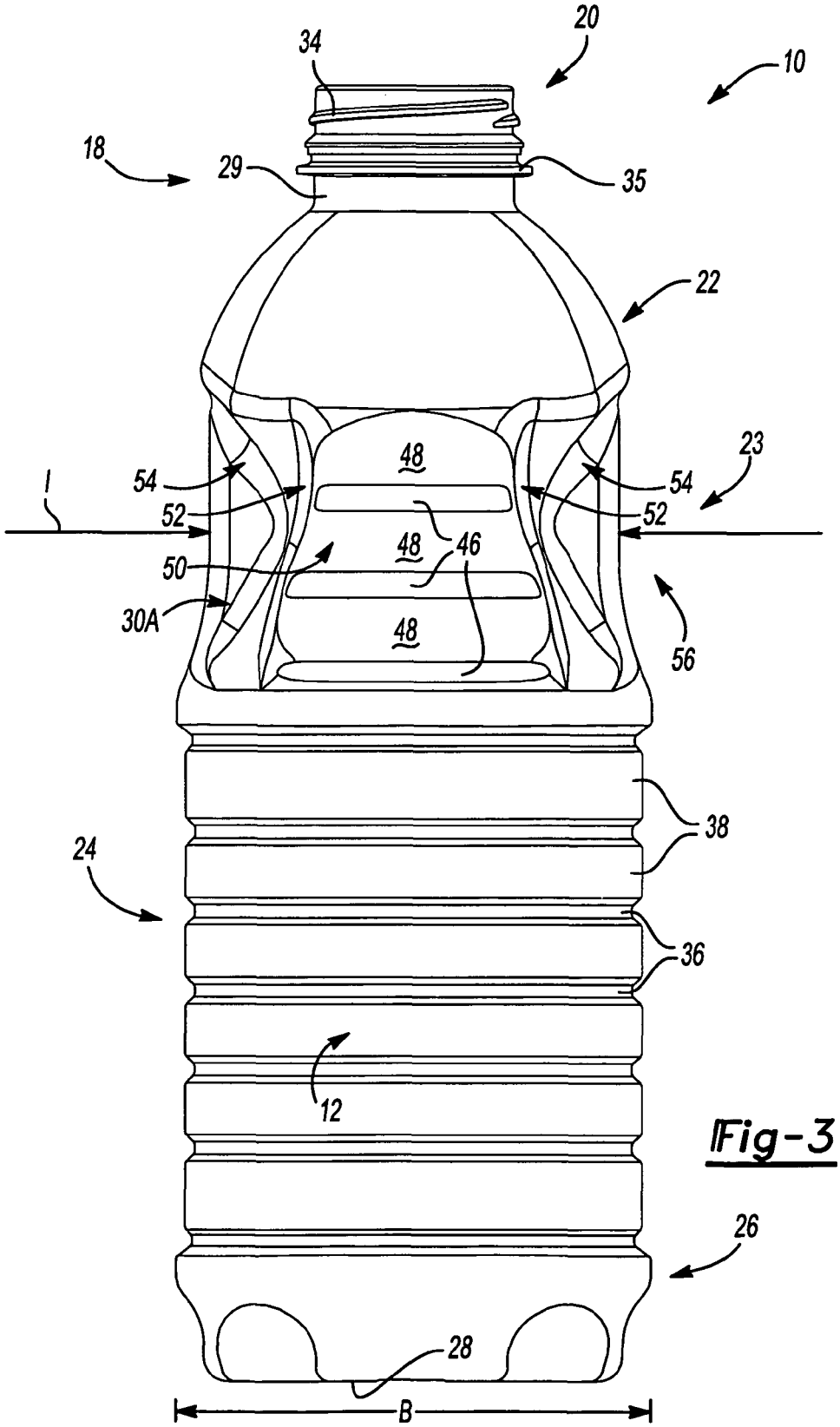
FIG. 3 is a side elevational view of the container of FIG. 1.
Figure 4:
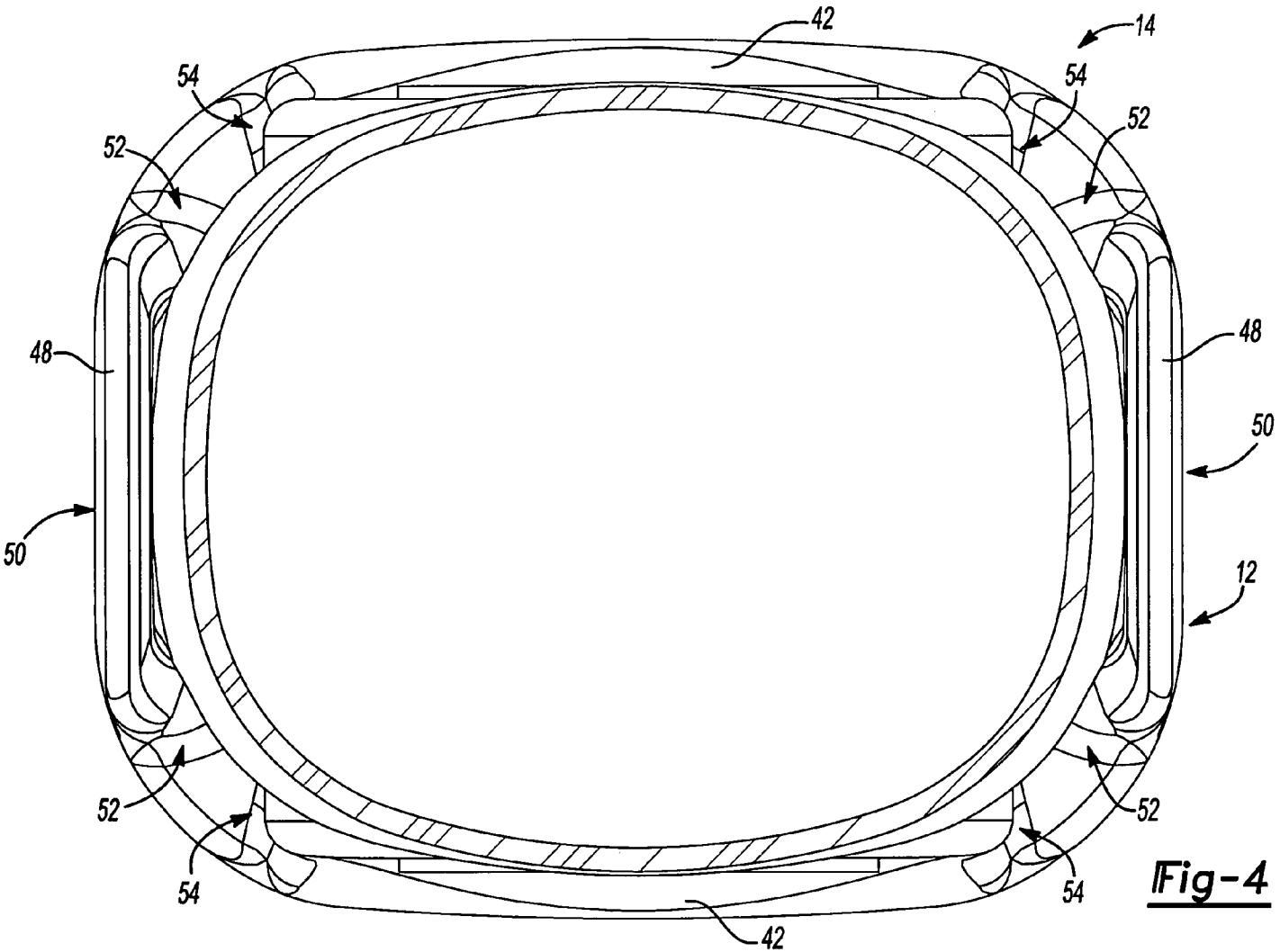
FIG. 4 is a sectional view of the container taken along line 4-4 of FIG. 2.

FIGS. 1-6 show one preferred embodiment of the present container. In the Figures, reference number 10 designates a one-piece plastic, e.g., polyethylene terephthalate (PET), hot-fillable container. As shown in FIG. 2, the container 10 has an overall height A of about 262.28 mm (10.33 inches). As best shown in FIGS. 1 and 4, the container 10 is substantially rectangular in cross sectional shape including first sides 12 each having a width B (FIG. 3), and opposing second sides 14 each having a width C (FIG. 2). In the example shown, the first sides 12 are shorter than the second sides 14. Opposing first sides 12 may be oriented at approximately 90-degree angles to the second sides 14 so as to form the generally rectangular cross section as shown in FIG. 4. The width B is about 93.99 mm (3.7 inches). The width C is about 119.00 mm (4.69 inches). The widths B and/or C may be selected so that the container 10 can fit within the door shelf of a refrigerator. In this particular example, the container 10 has a volume capacity of about 46 fl. oz. (1360 cc) to about 96 fl. oz. (2839 cc), and more preferably about 64 fl. oz. (1893 cc). Those of ordinary skill in the art would appreciate that the following teachings of the present invention are applicable to other containers, such as cylindrical, triangular, hexagonal, octagonal or square shaped containers, which may have different dimensions and volume capacities. It is also contemplated that other modifications can be made depending on the specific application and environmental requirements.

As shown in FIGS. 1-4, the one-piece plastic container 10 according to the present teachings defines a body 16 and includes an upper portion 18 having a finish 20. Integrally formed with the finish 20 and extending downward therefrom is a shoulder region 22. The body 16 can further define a mid-body 23 at the shoulder region 22. The shoulder region 22 merges into and provides a transition between the finish 20 and a sidewall portion 24. A grip panel area 25 can be provided at the mid-body 23. The sidewall portion 24 extends downward from the shoulder region 22 to a base portion 26 having a base 28. The exemplary container 10 may also have a neck 29 (FIG. 2). The neck 29 may have an extremely short height, that is, becoming a short extension from the finish 20, or an elongated height, extending from the finish 20 and the shoulder region 22.

The shoulder region 22 defines a pair of grip portions 30A and 30B at the mid-body 23. The construction of the grip portions 30A and 30B of the container 10 allows the shoulder region 22 to provide increased rigidity and structural support to the container 10. The base 28 functions to close off the bottom portion of the container 10 and, together with the finish 20, the shoulder region 22 and the sidewall portion 24, to retain the commodity.

With specific reference now to FIGS. 1 and 2, the finish 20 defines an opening 32. The finish 20 of the plastic container 10 may include a threaded region 33 having threads 34, and a support ring 35. The threaded region 33 provides a means for attachment of a similarly threaded closure or cap (not illustrated). Alternatives may include other suitable devices that engage the finish 20 of the plastic container 10. Accordingly, the closure or cap (not illustrated) engages the finish 20 to preferably provide a hermetical seal of the plastic container 10. The closure or cap (not illustrated) is preferably of a plastic or metal material conventional to the closure industry and suitable for subsequent thermal processing, including high temperature pasteurization and retort. The support ring 35 may be used to carry or orient a preform P (FIG. 7) through and at various stages of manufacture. For example, the preform P may be carried by the support ring 35, the support ring 35 may be used to aid in positioning the preform P in the mold, or an end consumer may use the support ring 35 to carry the plastic container 10 once manufactured.

The sidewall portion 24 further includes a series of horizontal ribs 36. Horizontal ribs 36 are uninterrupted and circumscribe the entire perimeter of the sidewall portion 24 of the container 10. Horizontal ribs 36 extend continuously in a longitudinal direction from the shoulder region 22 to the base 28. Defined between each adjacent horizontal rib 36 are lands 38. Lands 38 provide additional structural support and rigidity to the sidewall portion 24 of the container 10.

The mid-body 23 can define a first and a second arched rib 40 and 42, respectively (FIGS. 1 and 2). The arched ribs 40 and 42 can cooperate to define an oval shape at the grip panel area 25. The arched ribs 40 and 42 are generally stiff and provide increased structural support to the container 10 at the mid-body 23. The grip panel area 25 is intended to be the primary grip area for the container 10. The grip panel area 25 may be enhanced by creating a grip ledge introduced above the grip panel area 25 and/or profiling the width of the pillars 50 to an appropriate width for consumer handling.

Each grip portion 30A and 30B also may include horizontal ribs 46 (FIG. 3). Defined between each adjacent horizontal rib 46 are lands 48. Lands 48 provide additional structural support and rigidity to the grip portions 30A and 30B of the container 10. It should be understood that although only three horizontally extending lands 48 are illustrated, a series of horizontal lands 48 having varying lengths may be used.

Figure 5:
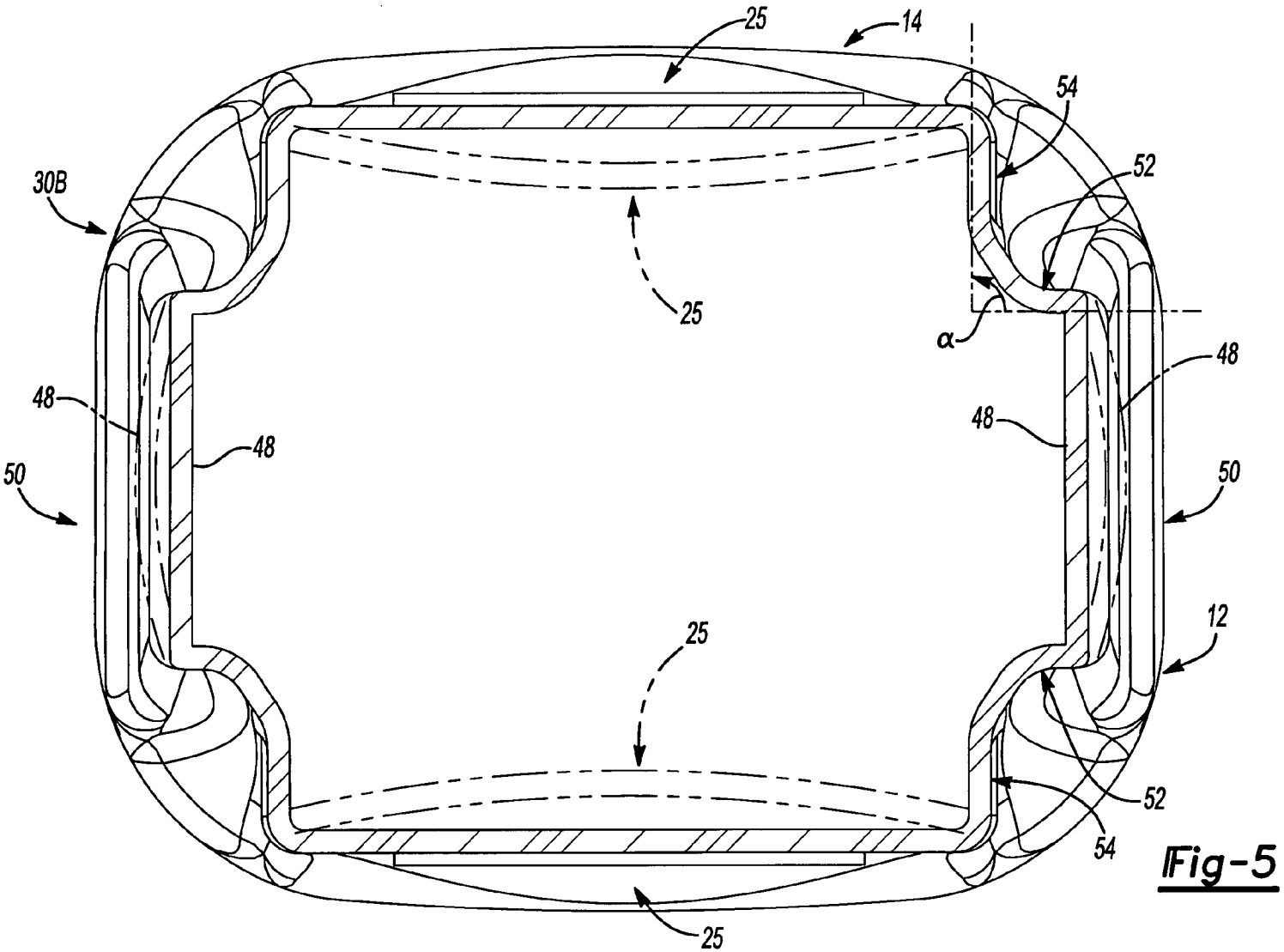
FIG. 5 is a sectional view of the container taken along line 5-5 of FIG. 2.

With reference now to all of the Figures, the grip portion 30A will be described in greater detail. For simplicity, only the grip portion 30A will be described in detail; however, it will be appreciated that the grip portion 30B is constructed similarly. In general, the grip portion 30A is defined by a generally vertical pillar 50 having a pair of oppositely facing walls 52 (FIG. 2). The pair of oppositely facing walls 52 are generally inset relative to the opposing second sides 14 (see FIG. 5). The opposing second sides 14 transition to the vertical pillars 50 through a pair of arched inset walls 54. In one example, the vertical pillars 50 define 20%-40% of a face 56 (FIG. 3) of the shoulder region 22. As best shown in FIG. 5, the oppositely facing walls 52 and the inset walls 54 can define an angle $\alpha$, such as 90 degrees, at the pillar 50. Other angles are contemplated. Such a configuration can provide a favorable customer handling point. Furthermore, the pillars 50 can evenly distribute vertical loads from the neck 29 to the body 16. The pillars 50 also provide a vertical structural component, which yields excellent top load strength capabilities.

After being filled with a hot product, capped and cooled, the product within the container 10 decreases in volume. This reduction in volume produces a reduction in pressure or a vacuum. The grip panel area 25 of the container 10 controllably accommodates this pressure reduction or vacuum by being capable of pulling inward, under the influence of the reduced pressure or vacuum, as shown in phantom lines in FIG. 5. The overall large dimension of the grip panel area 25 facilitates the ability of the grip panel area 25 to accommodate a significant amount of the reduced pressure or vacuum.

As the grip panel area 25 contracts inward, the more rigid horizontal lands 48 of each grip portion 30A and 30B deflect radially outward, providing a more linear or bowed outward orientation. This phenomenon is also shown in phantom lines in FIG. 5. Additionally, when a force is applied to the top of an empty container 10, grip panel area 25 is caused to contract inwards. This in turn causes the more rigid horizontal lands 48 to deflect radially outward, assuming a more linear or bowed outward orientation enhancing resistance to the applied force. Moreover, oppositely facing walls 52 and arched inset walls 54 provide and act as a hinge, facilitating the movement of the grip panel area 25 and the horizontal lands 48.

The grip portion 30A (and 30B) has been configured to define a geometry convenient for a consumer to grasp and hold the container 10. In one exemplary method of grasping the container 10, a consumer may wrap a hand around the first sides 12 at the grip portion 30A, such that a thumb engages one of the oppositely facing walls 52 formed on one of the pillars 50 and the remaining fingers engage the other of the oppositely facing walls 52 formed on the pillar 50. Because the arched inset walls 54 form a curved transition into the grip portion 30A, a consumer is offered directional guidance toward the oppositely facings walls 52 for improved leverage during gripping for better control and feel of the container 10.

The resultant geometrical configuration of the mid-body 23 provides improved localized strength at the grip portions 30A and 30B as well as creates a geometrically rigid structure. The resulting localized strength increases the resistance to creasing, buckling, denting, bowing and sagging of the shoulder region 22, the sidewall portion 24 and the container 10 as a whole during filling, packaging and shipping operations. Specifically, the resultant localized strength aids in preventing deformation during hot fill. As such, fillers are able to fill the container 10 quicker since the container 10 is able to withstand the additional pressures associated with faster filling speeds.

Figure 6:
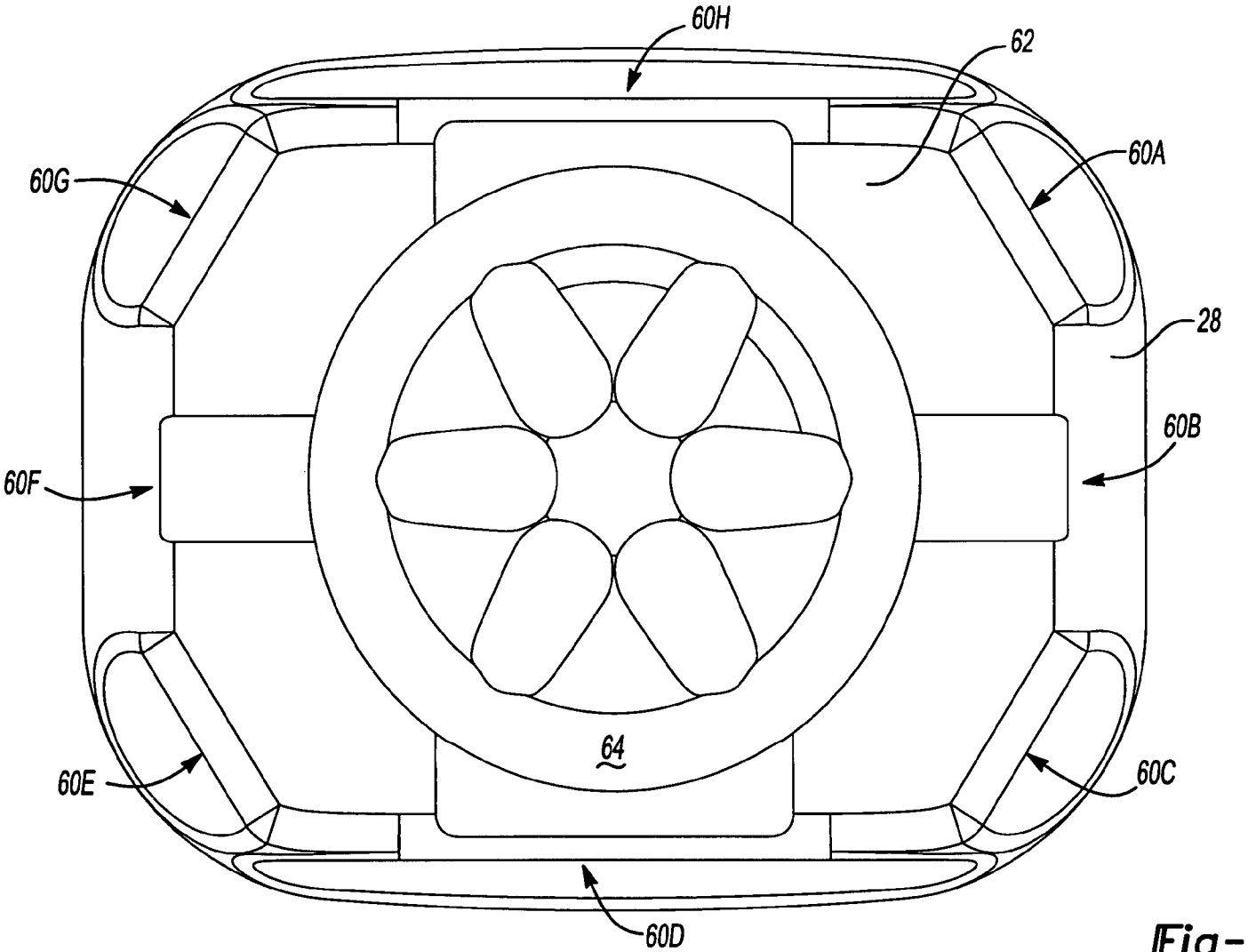
FIG. 6 is a bottom view of the container of FIG. 1.

With reference now to FIG. 6, the base 28 will be further described. The base 28 generally defines an octagonal shape creating a generally octagonal footprint and having sides 60A-60H. The base 28 generally includes a contact surface 62 and a circular push up 64. The contact surface 62 is itself that portion of the base 28 that contacts a support surface that in turn supports the container 10. As such, the contact surface 62 may be a flat surface or line of contact generally circumscribing, continuously or intermittently, the base 28. In one embodiment, as illustrated in FIG. 6, the contact surface 62 is a uniform, generally octagonal shaped surface that provides a greater area of contact with the support surface, thus promoting greater container stability. The circular push up 64 is generally centrally located in the base 28. Because the circular push up 64 is centrally located in the base 28, there is no need to further orient the container 10 in the mold. Thus promoting ease of manufacture.

Returning now to FIGS. 2 and 3, additional exemplary dimensions for the container 10 will be described. A height D of the finish 20 may be 18.31 mm (0.72 inch). A height E of the neck 29 may be 4.7 mm (0.19 inch). A height F of the shoulder region 22 taken from the support ring 35 to the sidewall portion 24 may be 117.22 mm (4.62 inches). A height G of the sidewall portion 24 may be 95 mm (3.74 inches). A height H of the base portion 26 may be 31.75 mm (1.25 inches). As shown in FIG. 3, a width I at the mid-body 23 may be 81.2 mm (3.20 inches). It is appreciated that these dimensions are merely exemplary and other dimensions may be used.

As explained above, the plastic container 10 has been designed to retain a commodity. The commodity may be in any form such as a solid or liquid product. In one example, a liquid commodity may be introduced into the container during a thermal process, typically a hot-fill process. For hot-fill bottling applications, bottlers generally fill the container 10 with a liquid or product at an elevated temperature between approximately 155° F. to 205° F. (approximately 68° C. to 96° C.) and seal the container 10 with a closure (not illustrated) before cooling. In addition, the plastic container 10 may be suitable for other high-temperature pasteurization or retort filling processes or other thermal processes as well. In another example, the commodity may be introduced into the container under ambient temperatures.

The plastic container 10 of the present invention is a blow molded, biaxially oriented container with a unitary construction from a single or multi-layer material. A well-known stretch-molding, heat-setting process for making the one-piece plastic container 10 generally involves the manufacture of the preform P (FIG. 7) of a polyester material, such as polyethylene terephthalate (PET), having a shape well known to those skilled in the art similar to a test-tube with a generally cylindrical cross section and a length typically approximately fifty percent (50%) that of the container height.

Figure 7:
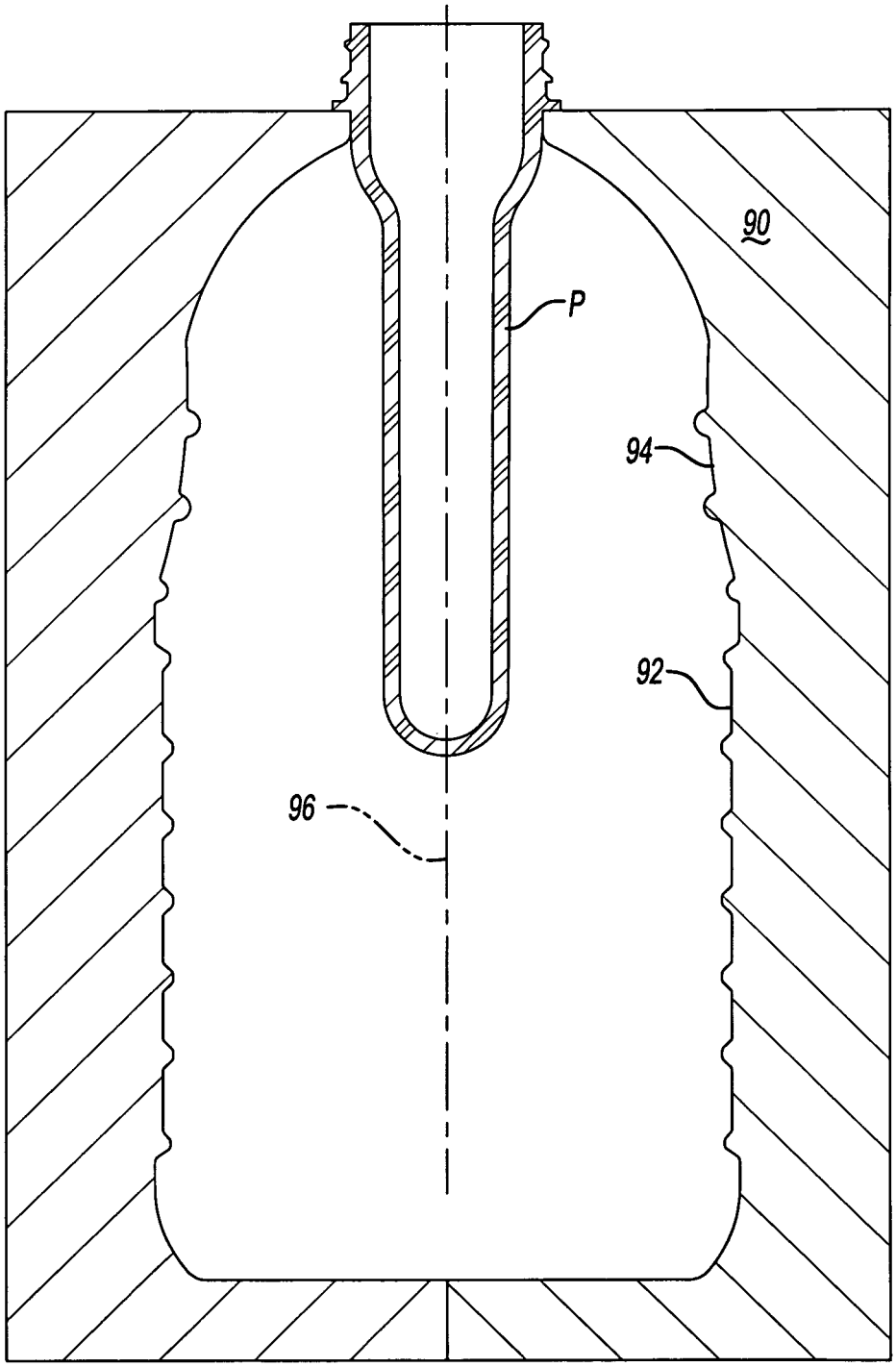
FIG. 7 is a sectional view of an exemplary mold cavity used during formation of the container of FIG. 1 and shown with a preform positioned therein.

Turning now to FIG. 7, an exemplary method of forming the container 10 will be described. At the outset, the preform P may be placed into a mold cavity 90. In general, the mold cavity 90 has an interior surface corresponding to a desired outer profile of the blown container. More specifically, the mold cavity 90 according to the present teachings defines a body forming region 92, including a grip forming region 94. In one example, a machine (not illustrated) places the preform P heated to a temperature between approximately 190° F. to 250° F. (approximately 88° C. to 121° C.) into the mold cavity 90. The mold cavity 90 may be heated to a temperature between approximately 250° F. to 350° F. (approximately 121 ° C. to 1 77° C.). A stretch rod apparatus (not illustrated) stretches or extends the heated preform P within the mold cavity 90 to a length approximately that of the end container 10 thereby molecularly orienting the polyester material in an axial direction generally corresponding with a central longitudinal axis 96 of the preform P and the resultant container 10. While the stretch rod extends the preform P, air having a pressure between 300 PSI to 600 PSI (2.07 MPa to 4.14 MPa) assists in extending the preform P in the axial direction and in expanding the preform P in a circumferential or hoop direction thereby substantially conforming the polyester material to the shape of the mold cavity 90 and further molecularly orienting the polyester material in a direction generally perpendicular to the axial direction, thus establishing the biaxial molecular orientation of the polyester material in the container 10. The pressurized air holds the mostly biaxial molecularly oriented polyester material against the mold cavity 90 for a period of approximately two (2) to five (5) seconds before removal of the container 10 from the mold cavity 90.

Alternatively, other manufacturing methods using other conventional materials including, for example, polypropylene, high-density polyethylene, polyethylene naphthalate (PEN), a PET/PEN blend or copolymer, and various multilayer structures may be suitable for the manufacture of the container 10. Those having ordinary skill in the art will readily know and understand plastic container manufacturing method alternatives.

While the above description constitutes the present disclosure, it will be appreciated that the disclosure is susceptible to modification, variation and change without departing from the proper scope and fair meaning of the accompanying claims.

What is claimed is:

1. A one-piece plastic container comprising:

a body defining a generally rectangular horizontal cross section including a first pair of opposing sidewalls and a second pair of opposing sidewalls, said body having an upper portion, a shoulder region, a sidewall portion and a base, said shoulder region integrally formed with and extending from said upper portion to said sidewall portion, said base closing off an end of said container, said shoulder region defining a grip panel area at said second pair of opposing sidewalls and a pair of grip portions defined in part by a respective pair of pillars, wherein each pillar of said pair of pillars defines oppositely facing walls that are offset inboard relative to the respective second pair of opposing sidewalls and arched inset walls, each of the arched inset walls having a respective longitudinal length, each of the arched inset walls arching concavely along the entire respective longitudinal length, wherein said oppositely facing walls and said arched inset walls act as a hinge such that said grip panel area is movable to accommodate vacuum forces generated within the container.

2. The one-piece plastic container of claim 1 wherein each arched inset wall transitions from a sidewall of said second pair of opposing sidewalls to a respective pillar of said pair of pillars.

3. The one-piece plastic container of claim 2 wherein each oppositely facing wall defines a substantially 90 degree angle relative to an adjacent arched inset wall at a horizontal cross-section taken through said shoulder region.

4. The one-piece plastic container of claim 1 wherein each pillar defines at least one horizontal rib and land formed therein.

5. The one-piece plastic container of claim 1, further comprising a first and a second arched rib defined on each of said second pair of opposing sidewalls, said first and second arched ribs cooperating to form a substantially oval geometry.

6. The one-piece plastic container of claim 1 wherein said base defines an octagonal shape having a generally octagonal footprint.

7. The one-piece plastic container of claim 1 wherein said sidewall portion defines a series of alternating ribs and lands formed therein.

8. The one-piece plastic container of claim 1 wherein said shoulder portion defines a shoulder face and wherein said pair of pillars define substantially about 20%-40% of said shoulder face.

9. A one-piece plastic container comprising:

a body defining a generally rectangular horizontal cross section including a first pair of opposing sidewalls and a second pair of opposing sidewalls, said body having an upper portion, a shoulder region, a sidewall portion and a base, said shoulder region integrally formed with and extending from said upper portion to said sidewall portion, said base closing off an end of said container, said shoulder region defining a first and a second arched rib defined on each sidewall of said second pair of opposing sidewalls, said first and second arched ribs cooperating to form a substantially oval geometry, a grip panel area and a pair of grip portions defined in part by a respective pair of pillars, wherein each pillar of said pair of pillars defines oppositely facing walls that are offset inboard relative to said respective second pair of opposing sidewalls and arched inset walls, each of the arched inset walls having a respective longitudinal length, each of the arched inset walls arching concavely along the entire respective longitudinal length, wherein said oppositely facing walls and said arched inset walls act as a hinge such that said grip panel area is movable to accommodate vacuum forces generated within the container.

10. The one-piece plastic container of claim 9 wherein each arched inset wall transitions from a sidewall of said second pair of opposing sidewalls to a respective pillar of said pair of pillars.

11. The one-piece plastic container of claim 10 wherein each oppositely facing wall defines a substantially 90 degree angle relative to an adjacent arched inset wall at a horizontal cross-section taken through said shoulder region.

12. The one-piece plastic container of claim 10 wherein said shoulder portion defines a shoulder face and wherein said pair of pillars define substantially about 20%-40% of said shoulder face.

13. The one-piece plastic container of claim 9 wherein each pillar defines at least one horizontal rib and land formed therein.

14. The one-piece plastic container of claim 9 wherein said sidewall portion defines a series of alternating ribs and lands formed therein.

15. The one-piece plastic container of claim 9 wherein said base defines an octagonal shape having a generally octagonal footprint.

16. A one-piece plastic container comprising:

a body defining a generally rectangular horizontal cross section including a first pair of opposing sidewalls and a second pair of opposing sidewalls, said body having an upper portion, a shoulder region, a sidewall portion and a base, said shoulder region integrally formed with and extending from said upper portion to said sidewall portion, said base closing off an end of said container, said shoulder region defining a grip panel area at said second pair of opposing sidewalls, a pair of grip portions defined in part by lands and a respective pair of pillars, wherein each pillar of said pair of pillars defines oppositely facing walls that are offset inboard relative to the respective second pair of opposing sidewalls and arched inset walls, wherein said oppositely facing walls and said arched inset walls act as a hinge such that said grip panel area is movable to accommodate vacuum forces generated within the container such that said grip panel area draws inward to form a generally concave shaped surface in cross section while said land expands outward to form a generally convex shaped surface in cross section when the container is filled and sealed.

17. The one-piece plastic container of claim 16 wherein each arched inset wall transitions from a sidewall of said second pair of opposing sidewalls to a respective pillar of said pair of pillars.

18. The one-piece plastic container of claim 16 wherein each pillar defines at least one horizontal rib and land formed therein.

19. The one-piece plastic container of claim 16, further comprising a first and a second arched rib defined on each of said second pair of opposing sidewalls, said first and second arched ribs cooperating to form a substantially oval geometry.

20. The one-piece plastic container of claim 16 wherein said shoulder portion defines a shoulder face and wherein said pair of pillars define substantially about 20%-40% of said shoulder face.

* * * * *